US007699926B2

(12) United States Patent
Huang

(10) Patent No.: US 7,699,926 B2
(45) Date of Patent: Apr. 20, 2010

(54) CHROME-FREE PASSIVATING SOLUTION

(75) Inventor: Kekun Huang, Guangdong (CN)

(73) Assignee: China International Marine Containers (Group) Co., Ltd., Guangdong (CN)

( * ) Notice: Subject to any disclaimer, the term of this patent is extended or adjusted under 35 U.S.C. 154(b) by 330 days.

(21) Appl. No.: 10/585,666

(22) PCT Filed: Jan. 7, 2005

(86) PCT No.: PCT/CN2005/000024

§ 371 (c)(1),
(2), (4) Date: Dec. 28, 2007

(87) PCT Pub. No.: WO2005/068683

PCT Pub. Date: Jul. 28, 2005

(65) Prior Publication Data

US 2008/0141900 A1 Jun. 19, 2008

(30) Foreign Application Priority Data

Jan. 8, 2004 (CN) ..... 2004 1 0021031

(51) Int. Cl.
*C09D 1/00* (2006.01)

(52) U.S. Cl. ..... 106/286.4; 106/286.1; 106/287.26; 106/287.23

(58) Field of Classification Search ..... 106/286.4, 106/286.1, 287.26, 287.23
See application file for complete search history.

(56) References Cited

U.S. PATENT DOCUMENTS 2,796,371 A * 6/1957 Ostrander et al. ..... 148/268
4,626,324 A * 12/1986 Samuels et al. ..... 205/259
4,927,472 A * 5/1990 Matsushima et al. ..... 148/261
5,171,474 A * 12/1992 Tono ..... 252/301.4 S
5,743,971 A * 4/1998 Inoue et al. ..... 148/247
6,524,403 B1 * 2/2003 Bartlett et al. ..... 148/247
6,638,369 B1 * 10/2003 Tucker et al. ..... 148/247
7,077,895 B2 * 7/2006 Akui et al. ..... 106/287.19

FOREIGN PATENT DOCUMENTS

CN 1268583 A 10/2000
CN 1301883 A 7/2001
CN 1386901 A 7/2006

* cited by examiner

*Primary Examiner*—Melvin C Mayes
*Assistant Examiner*—Melissa Stalder
(74) *Attorney, Agent, or Firm*—Lowe Hauptman Ham & Berner LLP

(57) ABSTRACT

The present invention related to a chrome-free passivating solution, which comprises following components: effective amount of oxysalt containing transition metal, inorganic acids and water. Said oxysalt containing transition metal is selected from a group of oxysalt containing titanium, oxysalt containing zirconium, oxysalt containing hafnium, oxysalt containing vanadium, oxysalt containing niobium, oxysalt containing tantalum, oxysalt containing molybdenum, oxysalt containing tungsten, oxysalt containing manganese, oxysalt containing technetium, and oxysalt containing rhenium, and the weight ratio between said oxysalt containing transition metal and inorganic acids is in the range of 200~400:1. Said chrome-free passivating solution may further comprise one or more complexant. The problem that noxious hexad and trivalent chrome existing in the galvanizing coat and passivating solution of the prior art is solved substantially by the chrome-free passivating solution of the present invention, and said chrome-free passivating solution of the present invention can replace really the passivating solution containing hexad and trivalent chrome of prior art, to complete the passivation of electro-galvanizing coat and hot-galvanizing coat.

16 Claims, No Drawings

CHROME-FREE PASSIVATING SOLUTION

RELATED APPLICATIONS

The present application is a National Phase application based on International Application Number PCT/CN2005/000024, filed Jan. 7, 2005, which claims priority from, Chinese Application Number 200410021031.1, filed Jan. 8, 2004, the disclosure of which is hereby incorporated by reference herein in its entirety.

FIELD OF THE INVENTION

The present invention relates to a solution for passivating electro-galvanizing coat and hot-galvanizing, and more particularly to a chrome-free passivating solution replacing the passivating solution containing hexad chrome and trivalent chrome.

DESCRIPTION OF PRIOR ART

Electro-galvanizing coat or hot-galvanizing coat must be passivated to enhance the corrosion resistance and to achieve a decorative appearance. At present, passivation for electro-galvanizing coat and hot-galvanizing coat is generally conducted by using chromate passivating solution, with a simple passivating process and low cost, to greatly improve the corrosion resistance of galvanizing coat of steel piece. However, either passive film formed by means of chromate passivation or waste chromate passivating solution contains hexad chrome, which is seriously harmful for human healthy and environment protection. It has been clearly prescribed by Chinese government that the waste chromate passivating solution must be treated before being discharged out. Many industrial sectors both in the country and abroad such as automobile, electronics, home appliance etc. also have stipulated to prohibit hexad chrome from being contained in the galvanizing coat after a certain time limit, even trivalent chrome is also prohibited to be contained in the galvanizing coat in some enterprises. Therefore, tremendous efforts have been made to provide a chrome-free passivating method in which no chromate passivating solution need to be used. A chrome-free passivating solution has been disclosed in a China Patent Application No. 00114178, titled "Chrome-free passivating solution used for protecting galvanizing coat and its coating method". The chrome-free passivating solution is prepared by "innocuous soluble molybdenate selected as inhibitor and innocuous water-soluble acrylic ester solution". Although the passivating solution is chrome-free, it is unable to replace the conventional chromate passivating solution, because the passivating solution must be coated on clean surfaces of galvanized pieces to form surface resin coat rather than really passivating the galvanizing coat. It is impossible to use the conventional chromate passivating equipment for said chrome-free passivating solution of above-mentioned application, so investment cost for equipment will be increased. Furthermore, the surface resin coat easily flakes off from the galvanizing piece so as to decrease its corrosion resistance and surface decorative effect. So far, there is no real chrome-free passivating solution, which can replace the chromate passivating solution.

SUMMARY OF THE INVENTION

The objective of the present invention is to provide a chromate-free passivating solution, which can replace the conventional chromate passivating solution for being used in the process of passivating the galvanizing coat, with substantially the same corrosion resistance as that provided by hexad chrome passivating process.

To achieve the object of the present invention, the present invention provides a chrome-free passivating solution, each liter of said chrome-free passivating solution comprises the following components:

| | |
|---|---|
| Salts containing free element | 20~35 g |
| Complexing agent | 18~38 g |
| Oxidation reducer | 0.05~0.15 g |
| Water | rest amount |

Said salt containing free element is a mixture of two kinds of salts containing free element, and the weight ratio between said two kinds of salts is in the range of 35~45:1.

Said salt containing free element is a mixture of one salt containing free element and other inorganic salt with chrome-free, and the weight ratio between said two kinds of salts is in the range of 35~45:1.

Said complexing agent is a mixture of three organic acids, and the weight ratio between three organic acids is 6:5:1.

Said complexing agent is a mixture of two organic acids and peroxide, and the weight ratio between two organic acids and peroxide is 6:5:1.

Said oxidation reducer is two inorganic acids, and the weight ratio between two inorganic acids is in the range of 7~10:1.

Said salt containing free element is composed of titanium, manganese, and molybdenum.

Said organic acids include citric acid, tartaric acid, pyrophosphate acid, nitrilotriacetic acid, and compound containing 8~28 oxygen atom, 4~16 hydroxy and 2~8 phosphoric acid.

Said inorganic acid consists of sulfuric acid, hydrochloric acid and nitric acid.

The chrome-free passivating solution of the present invention is made with salts containing free element, complexing agent, oxidation reducer and water by according to a specific proportioning. Compared with the prior art, the present invention not only substantially solves the problem that noxious hexad and trivalent chromes are present in the galvanized coat of the conventional products and the conventional passivating solution, eliminates the harm of the hexad and trivalent chromes to human and environment, really replaces the chromate passivating solution containing hexad and trivalent chrome to complete the passivation of electro-galvanizing coat and hot-galvanizing coat, solves the problem that the surface resin coat easily flakes off, the corrosion resistance of galvanizing coat passivated to the present invention is better than the corrosion resistance by using the conventional blue-white passivating technology, and equal to that by using the color passivating technology, but also can be used with the conventional chromate passivating equipment so as to lower application cost of the passivating solution, and the processing conditions such as temperature, time for passivating process is substantially the same as that of conventional chromate passivation, so tremendous cost for training staff members personnel is saved. Thus, the present invention has great economic benefit and social benefit.

Following is the detailed description of the preferred embodiment.

EXAMPLE 1

Take 20 g of salts containing free element such as potassium permanganate, titanyl sulfate and ammonium molybdate, 38 g of complexing agent for example citric acid, 0.15 g of oxidation reducer such as sulfuric acid, and mix these materials with water to prepare one liter of passivating solution with pH value of 1-3. The passivation operating condition is the same as that of the conventional chromate passivating technology. Under the room temperature, the galvanizing coat is immerged in the passivating solution for 4-10 seconds, then rinsed, dried and baked to gradually form passive film with Cambridge blue and jade-green.

EXAMPLE 2

Take 3500 g of salts containing free element, which is a mixture of ammonium molybdate and potassium permanganate with the weight ratio 35:1, namely taking ammonium molybdate of 3402.78 g, and potassium permanganate of 97.22 g, and take 1800 g of complexing agent of tartaric acid, 5 g of oxidation reducer of hydrochloric acid, then mix these materials with water to obtain 100 liter of passivating solution with pH value of 1-3.

The passivation process is the same as the example 1.

EXAMPLE 3

Take 200 of salts containing free element, which is a mixture of ammonium molybdate and sodium silicate with the weight ratio 45:1, namely taking ammonium molybdate of 195.65 g, and sodium silicate of 4.35 g, and take 38 g of complexing agent of pyrophosphate acid, 1.5 g of oxidation reducer of nitric acid, then mix these materials with water to obtain 10 liter of passivating solution with pH value of 1-3.

The passivation process is the same as the example 1.

EXAMPLE 4

Take 3000 g of salt containing free element, which could be made in accordance with any proportioning described in the example 1, 2, or 3, 2000 g complexing agent, which is a mixture of three organic-acid of which includes citric acid, tartaric acid and diphosphoric with the weight ratio 6:5:1, namely 1000 g of citric acid, 833 g of tartaric acid, and 167 g of diphosphoric acid, take 7 g of oxidation reducer, which could be nitric acid, hydrochloric acid or sulfuric acid, and mix these materials with water to obtain 100 liters of passivating solution with pH value of 1-3.

The passivation process is the same as the example 1.

EXAMPLE 5

Take 2500 g of salts containing free element (the same as example 4), 2500 g of complexing agent, which is a mixture of two organic acid of which could be diphosphoric acid and sodium triglycollamate or compound containing 8~28 oxygen atom, 4~16 hydroxy and 2~8 phosphoric acid, and peroxide with the weigh ratio 6:5:1, namely 1250 g of diphosphoric acid, 1042 g of sodium triglycollamate, 208 g of sodium peroxide, and take 5 g of oxidation reducer of which could be nitric acid, hydrochloric acid or sulfuric acid, and mix these materials with water to obtain 100 liters of passivating solution with pH value of 1-3.

The passivation process is the same as the example 1.

EXAMPLE 6

Take salts containing free element and complexing agent same as example 4 or 5, and the oxidation reducer is two inorganic acid such as sulfuric acid and hydrochloric acid, sulfuric acid and nitric acid, hydrochloric acid and sulfuric acid with the weigh ratio in the range of 7~10:1. Namely, if taking 5 g of oxidation reducer, one inorganic acid is of 0.625 g, the other is of 4.375 g; or one is of 0.45 g, the other is of 4.55 g. Then mix these materials with water to obtain 100 liters of passivating solution with pH value of 1-3.

The passivation process is the same as the example 1.

A multiple structure chrome-free passive film in the galvanizing coat is formed by salts containing transmition metal such as molybdenum, manganese and titanium, and complexing agent in the present invention reacting on the galvanizing coat. Through samples tests for the corrosion resistance of chromate-free passivating solution according to the present invention, it shows that the passivating technology is stable and practicable, and in accordance with standard completely.

What is claimed is:

1. A chrome-free passivating solution, characterized in that said chrome-free passivating solution comprises the following components:

effective amount of oxysalt containing transition metal, inorganic acids; and water;

wherein said oxysalt containing transition metal is selected from a group consisting of oxysalt containing titanium, oxysalt containing zirconium, oxysalt containing hafnium, oxysalt containing vanadium, oxysalt containing niobium, oxysalt containing tantalum, oxysalt containing molybdenum, oxysalt containing tungsten, oxysalt containing manganese, oxysalt containing technetium, and oxysalt containing rhenium, and the weight ratio between said oxysalt containing transition metal and inorganic acids is in the range of 200~400:1.

2. The chrome-free passivating solution as claimed in claim 1, characterized in that said chrome-free passivating solution further comprises a complexing agent.

3. The chrome-free passivating solution as claimed in claim 1, characterized in that said oxysalt containing transition metal is at least one or two selected from a group consisting of oxysalt containing titanium, oxysalt containing manganese, oxysalt containing molybdenum, oxysalt containing zirconium and oxysalt containing vanadium.

4. The chrome-free passivating solution as claimed in claim 3, characterized in that said oxysalt containing transition metal is a mixture of ammonium molybdate, potassium permanganate, and a weight ratio between ammonium molybdate and potassium permanganate is in the range of 35.about.45:1 or 1:35.about.45.

5. The chrome-free passivating solution as claimed in claim 1, characterized in that the inorganic acid is one or more selected from sulfuric acid, nitric acid, and hydrochloric acid.

6. The chrome-free passivating solution as claimed in claim 5, characterized in that the inorganic acids are two selected from a group consisting of sulfuric acid, nitric acid, and hydrochloric acid, and the weight ratio between sulfuric acid and nitric acid or hydrochloric acid, is 7.about.10:1 or 1:7.about.10.

7. The chrome-free passivating solution as claimed in claim 1, characterized in that the pH value of said chrome-free passivating solution is 1.about.3.

8. The chrome-free passivating solution as claimed in claim 1, characterized in that said chrome-free passivating solution further comprises one or more kinds of silicates.

9. The chrome-free passivating solution as claimed in claim 8, characterized in that said silicate is sodium silicate, potassium silicate or ammonium silicate.

10. The chrome-free passivating solution as claimed in claim 8, characterized in that the weight ratio between the oxysalt containing transition metal and the silicates is 35.about.45:1.

11. The chrome-free passivating solution as claimed in claim 2, characterized in that the complexing agent is organic acid or peroxide.

12. The chrome-free passivating solution as claimed in claim 2, characterized in that said organic acid is one or more selected from a group consisting of citric acid, tartaric acid, pyrophosphate acid, nitrilotriacetic acid, ethylene diamine tetramethyl phosphoric acid (EPTMP), sulfonamic acid, carboxyl acetic acid, ethylene diamine tetraacetic acid (EDTA), hydroxy-ethylidene diphosphonate (HEDP), 2-hydroxy phosphonoacetic acid, 1-hydroxy-2-naphthoic acid, diethylidene-triamine pentamethylene phosphonic (DTPMP), 1-hydroxy-2-(3-pyridyl)ethane-1,1-diphosphonic, hydroxylpropylidene-1,1-diphosphonic (HPDP), 2-hydroxy phosphonoacetic acid (HPAA), 1-hydroxy butylidene-1,1-diphosphonic acid (HBDP), 1-hydroxy-ethylidene-1,1-diphosphonic acid (HDEP), 1-hydroxy-hydroxy-diphosphonic acid.

13. The chrome-free passivating solution as claimed in claim 12, characterized in that the complexing agent is a mixture of citric acid, tartaric acid, pyrophosphate acid, and the weight ratio of citric acid:tartaric acid: pyrophosphate acid, is 6:5:1.

14. The chrome-free passivating solution as claimed in claim 12, characterized in that the complexing agent is a mixture of pyrophosphate acid, nitrilotriacetic acid and sodium peroxide, and the weight ratio of pyrophosphate acid: nitrilotriacetic acid:sodium peroxide is 6:5:1.

15. The chrome-free passivating solution as claimed in claim 1, characterized in that each liter of passivating solution contains the following components:

oxysalts containing transition metal 20.~.35 g
complexing agent 18.~.38 g
inorganic acid 0.05.~.0.15 g
water remains.

16. The chrome-free passivating solution as claimed in claim 15, characterized in that oxysalts containing transition metal are replaced with a mixture of said salt and silicate.

* * * * *